United States Patent [19]

Felix

[11] Patent Number: 4,657,164

[45] Date of Patent: Apr. 14, 1987

[54] WEB TENSION CONTROLLER

[76] Inventor: Willi Felix, Einsiegelweg 3, CH 4802 Strengelbach, Fed. Rep. of Germany

[21] Appl. No.: 640,035

[22] Filed: Aug. 10, 1984

[51] Int. Cl.[4] ..... B65H 20/24; B65H 20/36; B65H 23/192

[52] U.S. Cl. ..... 226/42; 226/44; 226/119

[58] Field of Search ..... 226/42, 44, 39, 118, 226/119, 143; 242/58.5, 75.47, 75.3

[56] References Cited

U.S. PATENT DOCUMENTS

| | | | |
|---|---|---|---|
| 3,464,610 | 9/1969 | Koning | 226/118 X |
| 3,487,986 | 1/1970 | Nelson et al. | 226/42 |
| 3,583,619 | 6/1971 | Shepherd | 226/119 X |
| 3,587,959 | 6/1971 | Glover | 226/44 X |
| 3,667,664 | 6/1972 | Schroeder | 226/42 X |
| 3,724,733 | 4/1973 | Schaffer et al. | 226/42 X |
| 3,823,934 | 7/1974 | Parenti et al. | 270/18 |
| 3,904,145 | 9/1975 | Steinberger et al. | 226/39 X |
| 3,974,949 | 8/1976 | Petersen | 226/42 |
| 4,011,976 | 3/1977 | Greer | 226/42 X |
| 4,025,005 | 5/1977 | Fleck et al. | 226/39 X |
| 4,126,817 | 11/1978 | Luzio | 318/7 |
| 4,134,559 | 1/1979 | Dyllus et al. | 226/119 X |
| 4,293,881 | 10/1981 | Mason | 226/118 X |
| 4,364,527 | 12/1982 | Bruno | 242/75.51 |
| 4,464,916 | 8/1984 | Grew et al. | 226/44 X |

FOREIGN PATENT DOCUMENTS 2022058 10/1979 United Kingdom .

OTHER PUBLICATIONS

Brandtjen & Kluge, Inc., Kluge Impressions, vol. 13, No. 7, published prior to Mar. 1966, p. 5.

*Primary Examiner*—Harvey C. Hornsby
*Assistant Examiner*—Scott J. Haugland
*Attorney, Agent, or Firm*—Davis Hoxie Faithfull and Hapgood

[57] ABSTRACT

This invention relates to an apparatus which feeds continuous paper web without breakage and maintains low and even web tension through an operating unit which has intermittent throughput including rapid web acceleration and reversal of web travel and permits incorporation of such an operating unit into a finishing line with other operating units which do not operate identically. The apparatus is well-suited, for example, for use in a laser printer-containing finishing line.

8 Claims, 2 Drawing Figures

WEB TENSION CONTROLLER

FIELD OF THE INVENTION

This invention relates to the control of tension in paper webs being put through continuous finishing lines having operating units which have sharply discontinuous throughput rates.

BACKGROUND OF THE INVENTION

In the graphics art industry continuous paper webs are put through many finishing operations. Paper webs may be perforated, printed, slit into individual documents, folded or glued to produce a variety of products. Machinery to perform several operations may be combined as units of a continuous finishing line. When this is done, control schemes are utilized to adjust the speeds of the various individual processing units so that a common throughput rate is achieved. Dancer control systems are a known means for adjusting the speeds of individual units to a common throughput rate. A dancer system utilizes a dancer roller in a loop of running web. The dancer roller is mounted on an arm and moves up or do the amount of web in the loop decreases or increases. The movement of the dancer roller actuates a transducer device, and thereby continously adjusts the throughput rate of an operating unit to maintain the position of the dancer roller within a preselected range of travel.

Certain operations in high speed paper handling have large instant-to-instant speed changes, however. Existing and proposed printers have that feature. Laser printers, which are at present capable of printing at average web throughput rates in the order of 150 feet per minute, not only stop periodically, but even reverse the direction of web travel during their printing cycles. The reversal, which is believed to occur during cleaning of the printer's selenium drum, is followed by a very rapid acceleration of the web to its forward operating speed. This type of intermittent operation at high rates tends to result in uneven and high web tensions leading to web breakage, and consequent shutdown of the finishing line.

It is important for proper laser printer operation that the web be under tension which is both low and uniform through the laser printer. Other processing units which may be included with a printer in a finishing line, however, do not match the intermittent operation of the printer and, therefore, tend to produce uneven and high tension at the printer. For example, web leaving a printer may be rewound onto a roll. Rewinding, even under dancer control, does not allow for the printer's reversal, leading to web breakage when the relatively high tension printer reverses.

SUMMARY OF THE INVENTION

This invention relates to an apparatus which feeds continuous paper web without breakage and maintains even, low web tension through an operating unit which has intermittent throughput including rapid web acceleration and reversal of web travel, and permits incorporation of such an operating unit into a finishing line with other operating units which do not operate identically. The web tension controller of this invention accommodates the kickback or reversal of a laser printer, while feeding and maintaining a low and even web tension through the laser printer in all its cycles. The tension controller of this invention is a self-contained unit which may be placed in a finishing line between an intermittently operating unit and another unit, thereby permitting those units to be combined into a finishing line without extensive modification, which otherwise would be required. It comprises a web feed comprising dancer-controlled, adjustable web feed drive responsive to the web needs of the intermittently operating unit and capable of maintaining very low and even web tension at a high rate of acceleration of the web; and dancer means and cooperating brake means to accommodate a kickback or reversal of the web while maintaining low and even web tension. The cooperating brake and dancer system makes a portion of the web available for a kickback without web breakage and isolates that portion of web from tension applied to the web by a downstream operating unit.

Accordingly, it is an object of this invention to prevent breakage when the operation of one unit of paper web finishing line, e.g., a laser printer, involves intermittent forward web travel, and even reverse web travel, with high rates of acceleration.

It is a further object of this invention to accommodate such intermittent web travel and also to feed the web at very low and even tension through an intermittent processor.

It is a further object of this invention to prevent web breakage and maintain very low even tension at operating speeds of 150 feet of web per minute and higher.

It is a further object of this invention to provide a self-contained apparatus for carrying out the previously listed objectives, which apparatus is insertable into a finishing line between two operating units and self-controlling based only on the web demands of the intermittently operating unit, e.g., a laser printer.

These and other objects and advantages will be readily apparent to persons skilled in the art from the following detailed description and accompanying drawings, which describe and illustrate the preferred embodiment of the invention.

DESCRIPTION OF THE PREFERRED EMBODIMENT

Figure 1:
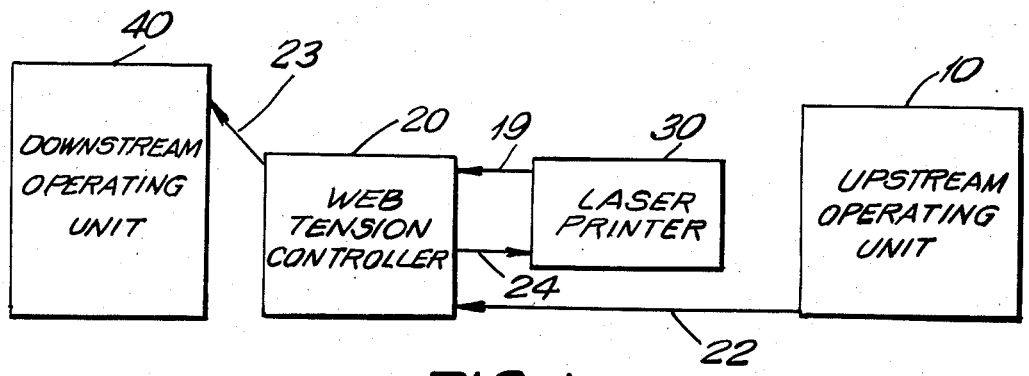
FIG. 1 is a block diagrammatic view of the elevation of a production line incorporating apparatus of this invention.

FIG. 1 depicts in block diagrammatic form the context of web tension controller 20 in a finishing line with an intermittently operating unit, here a laser printer 30, and the path of the continuous web 22, 24, 19, 23 through the finishing line. Web tension controller 20 obtains web (section 22) from an upstream operating unit 10, which may be, for example, an unwind unit or a web perforating unit. Web tension controller 20 feeds the web (section 24) at a very low and even tension to laser printer 30. Web (section 19) exiting the laser printer returns to web tension controller 20. Finally, the web (section 23) leaves web tension controller 20 and proceeds to a downstream operating unit 40, which may be, for example, a folder, a sheeter or web rewind unit.

Various upstream and downstream operating units are known in the art and need not be further described here. Similarly, means to adjust the throughput rates of upstream and downstream operating units, such as dancer roller control systems, are known in the art and need not be described here. In the finishing line of FIG. 1, if units 10 and 40 are unwind and rewind units, respectively, the finishing line preferably would be set up, as one skilled in the art would recognize, to operate at the maximum throughput rate of the laser printer.

As previously described, laser printer 30 has certain operational characteristics and requirements which present difficulties in handling of the web. The printer stops and reverses web travel periodically, following which it rapidly accelerates the web to the printer's forward operating speed. Laser printers accomplish these operations at an overall web throughput rate of about 150 feet per minute. Very low and even web tension must be maintained throughout the cycling of the laser printer to prevent web breakage.

Figure 2:
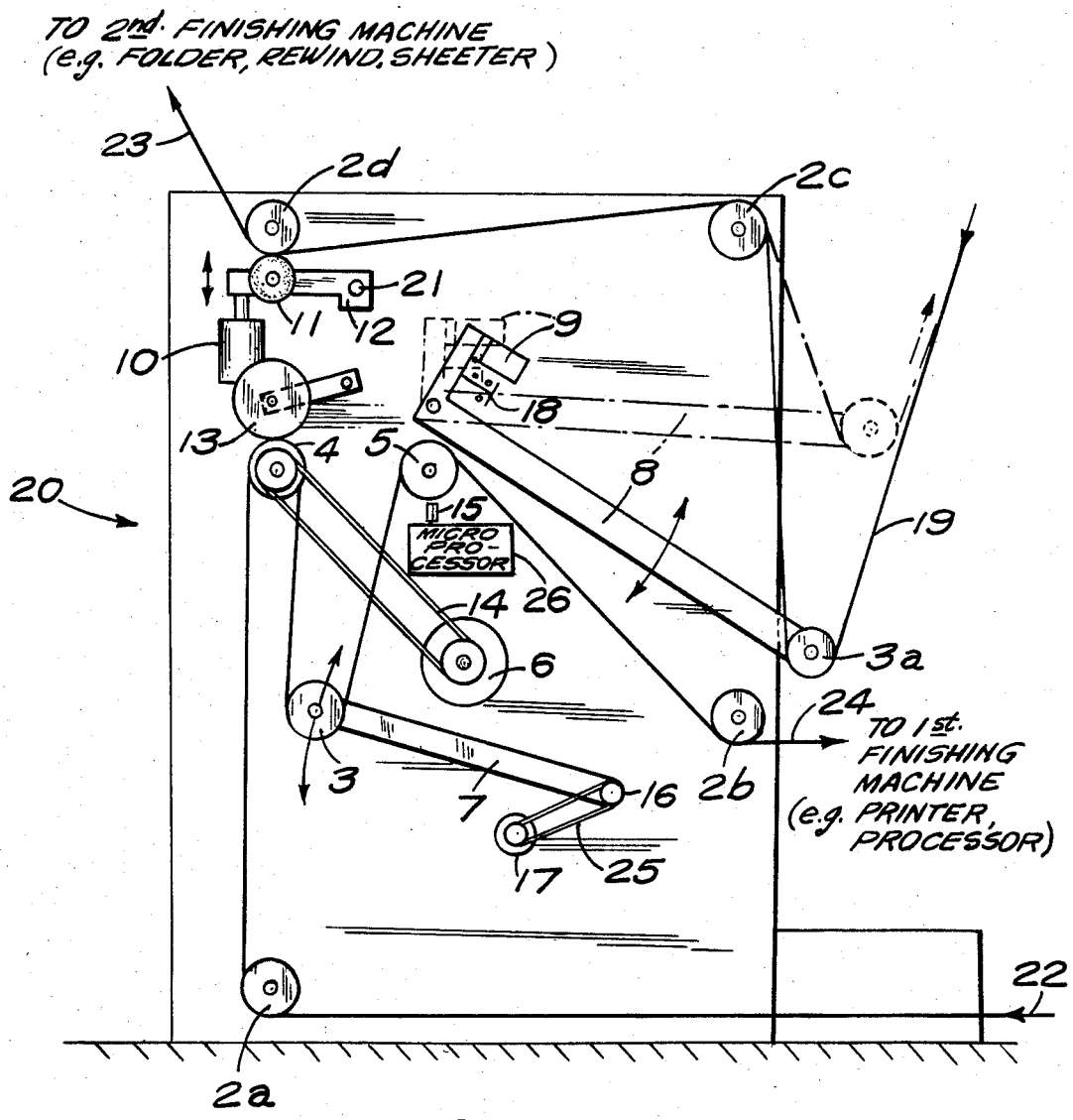
FIG. 2 is an elevation view of the web tension control apparatus of this invention.

FIG. 2 shows the preferred embodiment of the web tension controller 20. Web (section 22) enters controller 20 from an upstream operating unit (FIG. 1). The web passes under guide roller 2*a* and up over drive roller 4. Roller 13 presses the web against drive roller 4.

The web next passes under dancer roller 3, which is mounted on dancer arm 7. Dancer arm 7 is pivotally mounted on an axle 16, which is parallel to dancer roller 3 and supported by the frame of web tension controller 20. Position sensing means 17 detects the movement of dancer roller 3 and dancer arm 7 around pivot axle 16. In the embodiment shown in FIG. 2, position sensing means 17 is a potentiometer. Belt 25 connects potentiometer 17 to pivot axle 16 so that rotation of dancer arm 7 at pivot axle 16 results in a corresponding movement and change in setting of potentiometer 17.

Drive roller 4 is driven by an infinitely variable speed drive motor 6 via toothed belt 14. The speed of drive motor 6 is controlled by potentiometer 17 by conventional electrical means (not shown). After dancer roller 3, the web passes over a roller 5 and a guide roller 2*b*, and thence (web section 24) to laser printer 30 (FIG. 1). Roller 5 acts as a guide roller and also, by inclusion of a toothed wheel portion thereof, as part of a speed sensor, which may be described as a tachometer or an analog-to-digital convertor. The speed sensor also includes transducing or pulse generating means 15 to generate digital pulses at a rate corresponding to the speed of roller 5.

The generated digital pulses are input to microprocessor 26. Microprocessor 26 may be any of a number of commercially available off-the-shelf microprocessors programmed by known techniques to emit a signal in response to a slowing, a deceleration, in the rate of generated digital pulses input to the microcomputer.

Web controller 20 also includes means for receiving the web (section 19) which exits laser printer 30 (FIG. 1). Web (section 19) passes under dancer roller 3*a* carried by and on one end of arm 8, which is pivotally mounted at its other end. Arm 8 is L-shaped, including a perpendicular extension at its pivotally mounted end. Associated with arm 8 is a holding or latching means which maintains arm 8 in its lower position unless released. Referring to FIG. 2, hold or latching solenoid 9 normally holds the perpendicular extension of arm 8 so as to maintain arm 8 and dancer roller 3*a* in their lowered positions. Hold solenoid 9 is responsive to a signal from microprocessor 26 so as to release arm 8 when the rate of pulses originated by roller 5 being fed to the microprocessor decreases.

After passing under dancer roller 3*a* the web passes over guide roller 2*c* and under guide roller 2*d*. Associated with guide roller 2*d* is a braking means, here comprising rubber roller 11, which is mounted on lever arm 12 beneath guide roller 2*d*. Lever arm 12 is pivotally mounted on web tension controller 20 at 21. Mounted on web tension controller 20 beneath and at the other end of lever arm 12 is push solenoid 10, placed so that when push solenoid 10 is not energized, rubber roller 11 is spaced below guide roller 2*d* by more than the thickness of the paper web, but when push solenoid 10 is energized, rubber roller 11 is pushed upward into pinching contact with the web and guide roller 2*d*.

Push solenoid 10 is responsive to a signal from microprocessor 26, which by known means causes push solenoid to become energized when the rate of pulses originated by roller 5 being fed to the microprocessor decreases and to remain energized until switched off. Push solenoid 10 is cooperatively interconnected to dancer arm 8 by means of microswitch 18, which detects whether or not dancer arm 8 is in its lowest position. Deenergization of push solenoid 10 occurs via microswitch 18 and occurs only when dancer arm 8 is in its lowest position as determined by the microswitch.

In forward operation web (section 22) is pulled into web controller 20 by drive roller 4 in response to the demand for web by the intermittently operating unit, for example, laser printer 30 (FIG. 1). The speed of drive roller 4 is automatically adjusted to feed web (section 24) to the laser printer 30 at a very low and even tension by dancer control associated with dancer roller 3, as follows: dancer roller 3 applies a preselected, in this case very low, tension to the web. If the intermittently operating unit, laser printer 30 (FIG. 1), is calling for more web than is being delivered by drive roller 4, the web tension does not increase. Rather, the web loop around dancer roller 3 decreases, causing dancer roller 3 to move upward while maintaining a low and even web tension. Upward movement of dancer roller 3 causes dancer arm 7 to rotate at pivot axle 16, which movement is transmitted via belt 25 to potentiometer 17, which in turn speeds up motor 6, belt 14 and drive roller 4. The opposite happens if drive roller 4 is operating faster than the need for web by the laser printer. In sum, the dancer control system maintains a low and even tension on the web, and adjusts the speed of drive roller 4 to maintain the position of dancer roller 3 within a preselected vertical range.

When the intermittently operating unit stops, the dancer control system causes drive roller 4 to stop. The consequent deceleration of the web decelerates roller 5. The deceleration of roller 5 is sensed by speed sensor 15, which sends digital pulses at a slowing rate to microprocessor 26. Microprocessor 26, in response to deceleration of roller 5, simultaneously switches off hold solenoid 9 and activates push solenoid 10. Therefore, with the web feed to the intermittently operating unit, e.g., laser printer 30, stopped at drive roller 4, a downstream operating unit (FIG. 1) is prevented from tensioning the web by the firm pinch of the web between guide roller 2*d* and rubber roller 11.

If the intermittently operating unit next reverses the web travel, web for this part of the cycle is obtained from the loop beneath dancer roller 3*a*, which has been freed to move by the switching off of hold solenoid 9. Web breakage and high web tension are thereby prevented. The dotted line depiction of dancer arm 8, dancer roller 3*a* and web 19 shows the positions of these elements after a printer reverse. Dancer roller 3 can move lower to accommodate kickback of the web (section 24).

When the intermittently operating unit rapidly accelerates to its forward operating speed, dancer roller 3 maintains the low and even tension of web 24, thereby preventing web breakage. Drive roller 4 will be restarted, as described above for forward operation, to maintain the proper flow of web 24 at low and even tension. The forward acceleration of web (section 19) causes dancer arm 8 and lever arm 12 to be reset to their original positions, hold solenoid 9 to be energized and push solenoid 10 to be deenergized. It will be noted that deenergization of push solenoid 10 is dependent upon forward movement of web (section 19) to return dancer roller 3*a* to its lowered position, where it is subsequently maintained by hold solenoid 9. Microswitch 18 senses the return of dancer roller 3*a* to that position and switches off push solenoid 10. Thus, the brake means isolating the intermittently operating unit 30 (FIG. 1) from the downstream operating unit 40 is not released until drive roller 4 has "caught up" in the sense that it is supplying web to the intermittently operating unit at a low and even tension and the elements of web tension controller 20 have been returned to their forward operating configuration. From the beginning of intermittent stoppage until that time the brake means has prevented the downstream operating unit from pulling and tensioning the web (sections 19 and 24).

The upstream and downstream operating units (FIG. 1) will, of course, have their own speed controls as necessary for a finishing line. Well known dancer control systems can be used, for example, for those units.

As will be apparent from the foregoing description, web tension controller 20 is a self-contained, self-adjusting unit which controls all of its own functions in response to movement of the web passing through it as demanded by the laser printer or other intermittently operating unit. Web tension controller 20 is a free-standing unit which may be easily placed between the laser printer 30 and the downstream operating unit 40 and "connected" to them and the upstream operating unit only in the sense that the web passes through all four. Thus, neither the laser printer nor any other operating unit need be modified to make a finishing line.

While the construction and operation of apparatus herein described constitute a preferred embodiment of the invention, it is to be understood that the invention is not limited to the precise embodiment described and that changes may be made thereto without departing from the scope and spirit of the invention.

I claim:

1. An apparatus for maintaining low and even web tension through an intermittently reversing operating unit in a continuous web finishing line in response to the flow of web through said intermittently operating unit, comprising:

(a) adjustable positive web feed means for feeding web to the intermittently operating unit;

(b) web feed control means located between the web feed means and the intermittently operating unit for sensing the demand for web by the intermittently operating unit and adjusting the speed of the web feed means to that demand, said web feed control means including means for maintaining low and even web tension during rapid acceleration of the web through the intermittently operating unit;

(c) brake means located downstream of the intermittently operating unit for stopping the web after it has exited the intermittently operating unit and preventing the transfer of tension on the web from a downstream operating unit to the intermittently operating unit;

(d) bistate reversal control means located between the intermittently operating unit and said brake means, said bistate reversal control means having a first mode for maintaining during forward operation of the intermittently operating unit a preselected quantity of web available to accomodate periodic reversal of web travel through the intermittently operating unit and a second mode for maintaining low and even web tension during reversal of web travel through the intermittently operating unit;

(e) said web feed control means including means to accommodate said preselected quantity of web upon said periodic reversal of the intermittently operating unit;

(f) first sensing and control means, responsive to forward deceleration of the web through the intermittently operating unit for turning on said brake means and for switching said bistate reversal control means to its second mode of maintaining low and even web tension during reversal of web travel through the intermittently operating unit; and (g) second sensing and control means, responsive to the bistate reversal control means, for releasing the brake and for switching said bistate reversal control means to its first mode of maintaining said preselected quantity of web.

2. The apparatus according to claim 1, wherein said apparatus comprises a free-standing web tension controller from which web is both fed to and received from said intermittently operating unit, wherein said controller is connected to said intermittently operating unit and said downstream unit only through the web.

3. The apparatus according to claim 2, wherein said web feed control means and said bistate reversal control means comprise dancer means.

4. The apparatus according to claim 2, wherein said intermittently operating unit is a laser printer.

5. The apparatus according to claim 2, wherein said first sensing and control means comprises transducer means and microprocessor means.

6. The apparatus according to claim 5, wherein said web feed control means and said bistate reversal control meeans comprise dancer means.

7. A process for maintaining low and even web tension through an intermittently reversing operating unit in a continuous web finishing line in response to the flow of web through said intermittently operating unit, comprising:

(a) sensing the rate of web travel through said intermittently operating unit;

(b) positively feeding web under low and even tension at an adjustable rate according to and responsive to the forward rate of web travel through the intermittently operating unit;

(c) maintaining, during forward travel of the web through the intermittently operating unit, a preselected quantity of web exiting the intermittently operating unit available to accommodate periodic web reversal through the intermittently operating unit;

(d) in response to sensing forward deceleration of the web through the intermittently operating unit, braking the web downstream of the said preselected quantity thereby preventing tensioning of the web upstream of the brake by any action downstream of the brake, and releasing said preselected quantity of web to supply web for web reversal through the intermittently operating unit;

(e) on reversal of the web through the intermittently operating unit, maintaining low and even web tension on the web both on the upstream side of the intermittently operating unit and the downstream side of the intermittently operating unit;

(f) sensing reattainment of said preselected quantity of web exiting the intermittently operating unit; and (g) in response to reattainment of said preselected quantity of web, disengaging braking and again maintaining said preselected quantity of web.

8. The process according to claim 7, wherein the braking and releasing step is microprocessor controlled.

* * * * *